United States Patent [19]

Koch

[11] 4,149,484

[45] Apr. 17, 1979

[54] CUTTING APPARATUS

[75] Inventor: Johannes Koch, Amsterdam, Netherlands

[73] Assignee: Buhrs-Zaandam B.V., Zaandam, Netherlands

[21] Appl. No.: 865,188

[22] Filed: Dec. 28, 1977

[30] Foreign Application Priority Data

Oct. 7, 1977 [NL] Netherlands ..... 7711013

[51] Int. Cl.[2] ..... B26D 5/20

[52] U.S. Cl. ..... 118/42; 83/112; 83/152; 83/156; 83/251; 83/260; 83/262; 118/50; 118/249

[58] Field of Search ..... 83/112, 152, 156, 251, 83/260, 262; 118/42, 50, 249

[56] References Cited

U.S. PATENT DOCUMENTS

| | | | |
|---|---|---|---|
| 998,736 | 7/1911 | Armstrong | 83/260 |
| 2,318,107 | 5/1943 | Scheffey | 83/260 X |
| 2,947,358 | 8/1960 | Hawxhurst | 83/260 X |

*Primary Examiner*—J. M. Meister

*Attorney, Agent, or Firm*—Lane, Aitken & Ziems

[57] ABSTRACT

A cutting apparatus for severing portions of identical length from a strip. This cutting apparatus comprises a feed means which is coupled to a drive means and which is adapted to feed the strip to a pair of advancing rolls located between the feed means and a cutting element. One of these advancing rolls is coupled to the drive means and is provided with a cam surface having a larger radius than the remaining roll surface. This cam surface, together with the other advancing roll, is adapted to engage the strip to move the strip forward towards a pair of receiving rolls through a distance determined by said cam surface. The central axes of the receiving rolls lie in a plane that is parallel to the plane through the central axes of the advancing rolls. The receiving rolls are located on the side of the cutting element remote from the advancing rolls, at such a distance from the advancing rolls that the front end of the strip, in the position where it is released by the advancing rolls, lies in the plane through the central axes of the receiving rolls. One of the receiving rolls is coupled to the drive means and is provided with a recess in its circumferential surface. The cutting element is controlled so as to perform the cutting operation at the moment in which this recess is located adjacent the other receiving roll, thus causing the strip to be released, whereupon the severed strip portion is removed. The driven advancing roll and the driven receiving roll are driven at the same peripheral velocity as measured with respect to their maximum radius while a manually operated adjusting mechanism is coupled to one of these latter rolls for readjusting this roll.

14 Claims, 8 Drawing Figures

CUTTING APPARATUS

BACKGROUND OF THE INVENTION

The invention relates to a cutting apparatus comprising a cutting element for severing portions of identical length from a strip.

SUMMARY OF THE INVENTION

It is a first object of the present invention to provide a cutting apparatus which is of a simple construction.

It is a further object of the present invention to provide a cutting apparatus whereby the length of the strip portions to be severed can be accurately readjusted.

To this end, the cutting apparatus according to the invention is characterized by a feed means which is coupled to a drive means and which is adapted to feed said strip to a pair of advancing rolls located between said feed means and a cutting element, one of said advancing rolls being coupled to the drive means and being provided with a cam surface having a larger radius than the remaining roll surface, which cam surface, together with the other advancing roll, is adapted to engage the strip and to move the strip forward towards a pair of receiving rolls through a distance determined by said cam surface, the central axes of said receiving rolls lying in a plane that is parallel to the plane through the central axes of the advancing rolls, said receiving rolls being located on the side of the cutting element remote from said advancing rolls, at such a distance from said advancing rolls that the front end of the strip, in the position where it is released by the advancing rolls, lies in the plane through the central axes of said receiving rolls, one of said receiving rolls being coupled to the drive means and being provided with a recess in its circumferential surface, said cutting element being controlled so as to perform the cutting operation at the moment in which this recess is located adjacent the other receiving roll, thus causing the strip to be released, whereupon the severed strip portion is removed, the driven advancing roll and the driven receiving roll being driven at the same peripheral velocity as measured with respect to their maximum radius, a manually operated adjusting mechanism being coupled to one of these latter rolls for readjusting this roll.

This cutting apparatus constitutes a simple and compact construction and allows the length of the strip portions to be severed to be manually adjusted with great precision by means of the adjusting mechanism.

The cutting apparatus is particularly suitable, for example, for dividing address strips on which a number of addresses are arranged side by side and which have been formed by cutting a computer sheet with addresses into strips.

In order to raise the precision of the cutting apparatus still further, the cutting element may be displaceable in a plane which is parallel to the aforementioned planes between an upper rest position and a lower position, while the feed means are adapted to feed the strip to a position wherein the front end of the strip abuts the cutting element which is in its lower position and which acts as a stop, whereupon the feed means release the strip.

In a preferred embodiment of the cutting apparatus according to the invention, the adjusting means may be coupled to the driven advancing roll.

The recessed receiving roll may be provided with a second recess, while the leading end of said second recess may lie simultaneously with the rear end of the severed strip portion in the plane through the central axes of the receiving rolls.

Further, the advancing roll provided with the cam surface may be driven by an electromotor through a planet system comprising two sun gear wheels, the angular position of the planet carrier about the central axis of the sun gear wheels being adjustable by means of the adjusting mechanism.

This planet carrier may consist of a worm wheel, which is adjustable by means of a worm coupled to a manually adjustable handle.

The planet system may further comprise a drive gear wheel coupled to the first sun gear wheel which is co-axial therewith, said first sun gear wheel meshing with a first planet gear wheel of a planet which is rotatably supported in the planet carrier and which comprises a second planet gear wheel, said second planet gear wheel being coupled to the first planet gear wheel and being co-axial therewith, said second planet gear wheel meshing with the second sun gear wheel, the number of teeth of which is different from that of the first sun gear wheel, and which is coupled to a co-axial gear wheel, said latter gear wheel driving the advancing roll.

In view of the subsequent treatment of the severed strip portions, a vacuum cylinder for taking over the severed strip portions may be arranged beyond the pair of receiving rolls and may be coupled to the drive means.

This may be combined with a glueing cylinder arranged adjacent the vacuum cylinder for imparting a layer of glue to the severed strip portion, which passes on the vacuum cylinder, whereafter this strip portion is moved further by the vacuum cylinder to a point of delivery, where the strip portion is glued onto an underlying object.

DESCRIPTION OF A PREFERRED EMBODIMENT

Figure 1:
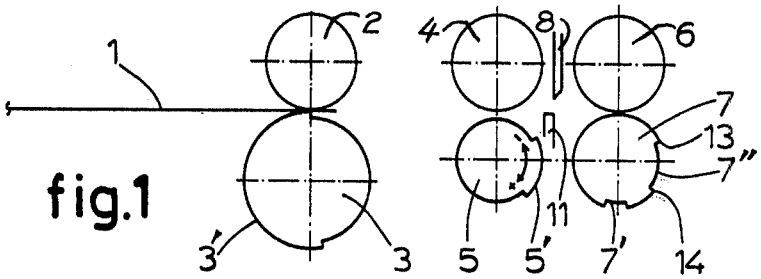
FIGS. 1 to 7 inclusive show schematically the various steps of passing a strip through a cutting apparatus according to the invention.

FIG. 1 shows schematically a cutting apparatus according to the invention in a position wherein the initial portion of a strip 1, from which portions of identical length are to be severed with high dimensional accuracy, is engaged between a pair of feed rolls 2, 3.

In the example shown, the strip 1 is an address strip upon which a number of addresses are arranged side by side and which has been formed by cutting a computer sheet with addresses into strips. Such a strip 1 has to be cut to labels each showing one address with the use of the cutting apparatus according to the invention. Of course, it is also possible to use the cutting apparatus according to the invention for cutting other kinds of strips into parts.

The computer sheet can be supplied in a direction perpendicular to the plane of the drawing and, the marginal perforations having been removed, can be divided into strips 1 which successively reach the feed rolls 2, 3.

In the embodiment shown in the drawing, the upper feed roll 2 is cylindrical, while the driven lower feed roll 3 comprises a projecting cam surface 3' and is otherwise cylindrical. When this cam surface 3' is inactive, as is the case during the lateral infeed of the strip 1, the strip 1 is not engaged by the feed rolls 2, 3. Contact with the strip 1 only starts when the leading end of the cam surface 3' reaches the plane through the central axes of the rolls 2, 3 as shown in FIG. 1.

A pair of advancing rolls 4, 5 are arranged beyond the feed rolls 2, 3. In the embodiment shown, the upper advancing roll is cylindrical, while the driven lower advancing roll 5 comprises a projecting cam surface 5' and is otherwise cylindrical. As long as the cam surface 5' is inactive, there is a gap between the advancing rolls 4, 5 which prevents an inserted strip 1 from being engaged by the advancing rolls 4, 5.

A pair of receiving rolls 6, 7 extend beyond the advancing rolls 4, 5. In the embodiment shown, the upper receiving roll 6 is cylindrical, while the driven lower receiving roll 7 comprises two recessed portions 7', 7'', but is otherwise cylindrical.

The rolls 2, 3, 4, 5, 6 and 7 have parallel central axes perpendicular to the plane of the drawing, the planes through the central axes of the pairs of rolls 2,3; 4,5 and 6,7 being parallel as well as vertical. The rolls 3, 5 and 7 are all driven at the same angular speed, with the feed roll 3 having a larger diameter than the advancing roll 5 and the receiving roll 7. The higher peripheral speed of the feed roll 3 is of importance in compensating the time loss during the infeed of a new strip 1. The rolls 2, 4 and 6 are supported in such a manner as to be freely rotatable.

Furthermore, as indicated in FIG. 1, the pairs of rolls 2,3; 4,5 and 6,7 are so positioned as to allow these pairs of rolls to make contact with a horizontal strip 1, which is supported on a flat supporting table, not shown, in which openings are formed for the rolls 3, 5 and 7.

A cutting blade 8 can be vertically raised and lowered between the advancing rolls 4, 5 and the receiving rolls 6, 7, which blade protrudes downwards through an opening in the supporting table when it is in its lower position.

Figure 3:
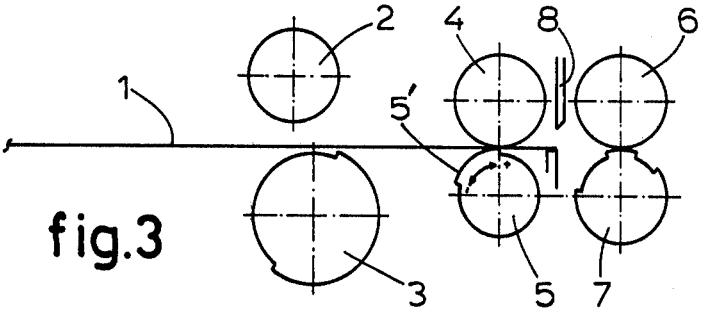

It is furthermore possible to displace the upper feed roll 2 from its operating position shown in FIG. 1 away from the lower feed roll 3 (FIG. 3). To this end, this feed roll 2 can be swung about an axis which is spaced from its axis of rotation.

Figure 7:
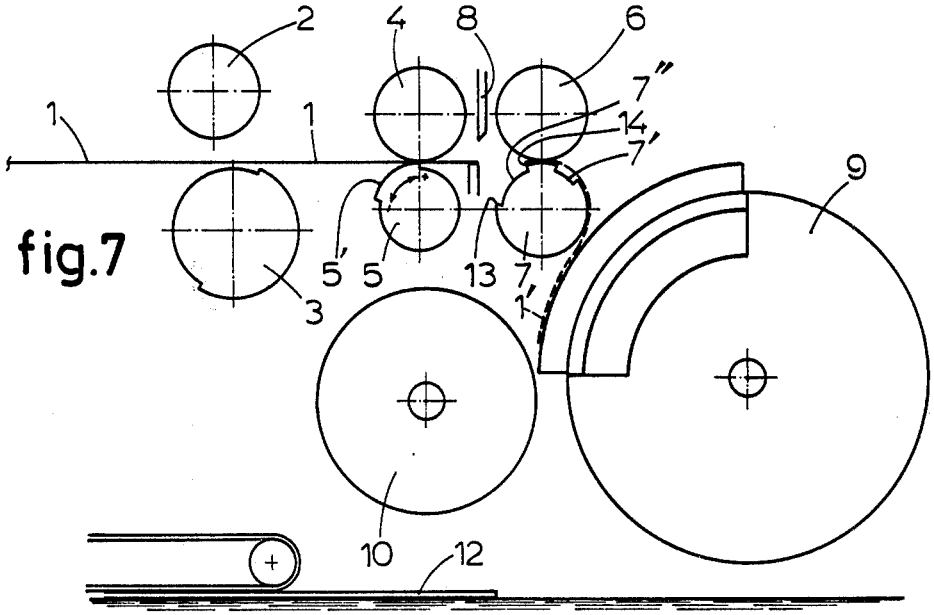

The embodiment shown, in which address strips 1 are processed by the cutting apparatus, comprises a vacuum cylinder 9 (FIG. 7) beyond the pair of receiving rolls 6, 7, which vacuum cylinder 9 co-operates with a glueing cylinder 10.

Figure 2:
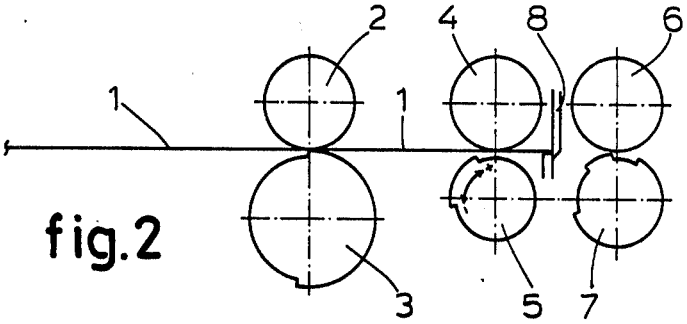

The operation of the cutting apparatus according to the invention as described hereinabove is as follows:

The strip 1, having just been engaged by the feed rolls 2, 3 as shown in FIG. 1, is advanced by these feed rolls 2, 3 along the supporting table through a distance which corresponds to the developed length of the cam surface 3'. The strip 1 passes through the gap which is present during that step between the advancing rolls 4, 5. At this stage the blade 8 functions as a stop, for which purpose it has been moved downwardly (FIG. 2). The front end of the strip 1 reaches this lowered blade 8 at exactly the moment in which the strip 1 is released by the feed rolls 2, 3. The blade 8 thus prevents the strip 1 from sliding through and ensures exactly the correct position for the strip 1 after it has been released by the feed rolls 2, 3. The blade 8 is then raised again.

The upper feed roll 2 is swung upwardly at the same time so as to enable the feed rolls 2, 3 to perform a number of revolutions without making contact with the strip 1 (FIG. 3).

Figure 4:
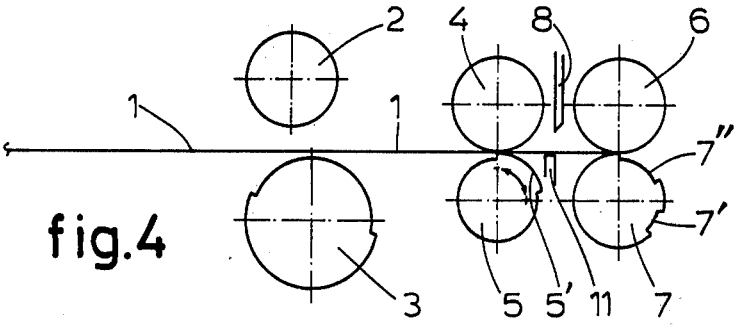
Figure 5:
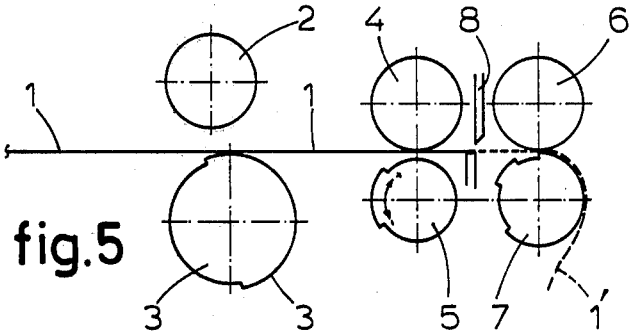

The advancing rolls 4, 5 engage the strip 1 and advance the strip 1 through a distance which is exactly equal to the developed length of the cam surface 5' of the lower advancing roll 5, so that the front end of the strip 1 just reaches the vertical plane through the central axes of the receiving rolls 6, 7 (FIG. 4). The receiving rolls 6, 7 then take over the strip 1 which is no longer in contact with the advancing rolls 4, 5. When the recess 7' in the receiving roll 7 has reached its position underneath the receiving roll 6, the strip 1 is released temporarily by the receiving rolls 6, 7 (FIG. 5).

Figure 6:
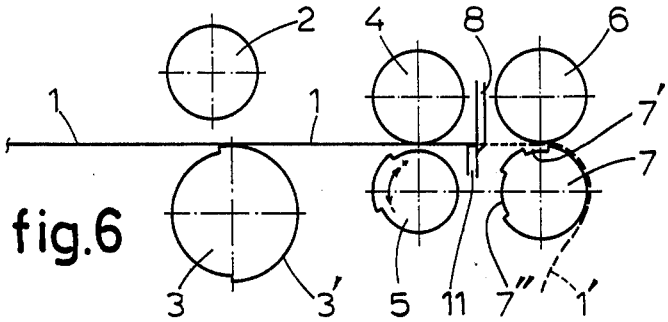

The blade 8 is then lowered and first presses the strip 1 onto the lower blade 11 with the use of a spring loaded pressure member (not shown) connected to the blade 8. Thereupon the blade 8 cuts the strip 1, which is stationary during the cutting operation, along a cutting line which is exactly at right angles to the longitudinal direction (FIG. 6). The blade 8 is then raised again.

The portion 1' which has been severed from the strip 1 and which bears one address is transported under the action of friction by the receiving roll 6 which is still rotating. After the recess 7' in the lower receiving roll 7 has passed the vertical plane through the central axes of the receiving rolls 6, 7, the severed strip portion 1' is again positively engaged by the receiving rolls 6, 7. At the same time, the advancing rolls 4, 5 will make contact with the remaining strip (FIG. 7) and transport it further on its way.

The severed strip portion 1' is transferred by the lower receiving roll 7 to the vacuum cylinder 9, which rotates along the glueing cylinder 10. This glueing cylinder 10 applies a layer of adhesive to the severed strip portion 1', whereupon this severed strip portion 1' is affixed to an envelope 12, a wrapper or similar object which has in the meantime arrived underneath the vacuum cylinder 9.

As an alternative for the glueing cylinder 10, use can also be made of a moistening cylinder in case that the strip 1 has already been provided with an adhesive layer which must be activated by moistening.

The steps described are repeated until the strip 1 has been reduced to a portion bearing only one address. This final strip portion 1' eventually reaches the receiving rolls 6, 7, at which time the blade 8 performs an idle stroke at the moment in which the recess 7' in the receiving roll 7 comes to lie underneath the receiving roll 6, as a result of which motion the blade again reaches its lower position, wherein it acts as a stop.

A new strip 1 of the computer sheet has by then already been supplied between the feed rolls 2, 3, the feed roll 2 having been swung back to the position shown in FIG. 1, so that the cycle can be repeated.

On the one hand, the feed rolls 2, 3 advance the new strip 1 to the position according to FIG. 2; on the other hand, the final strip portion 1' of the preceding strip 1 is removed by the receiving rolls 6, 7 and the vacuum cylinder 9.

In the embodiment shown, the lower advancing roll 5 and the lower receiving roll 7 have the same maximum radius.

The recess 7'' is so dimensioned that the leading edge of this recess 7'', as viewed in the direction of rotation of the receiving roll 7, lies simultaneously with the rear end of the severed strip portion 1′ in the plane through the central axes of the receiving rolls 6, 7.

Although this measure is not absolutely essential, it greatly facilitates the adjustment of the cutting apparatus. The reason is that, if the rear end of the severed strip portion 1′ coincides indeed with the front end of the recess 7″, the maximum length of a severed strip portion 1′ is equal to the developed length of an arc with the maximum radius of the receiving roll 7 and extending between the generating line 13 and the generating line 14. This maximum length of the strip portion 1′ is obtained if, as shown in FIG. 4, the front end of the strip 1 reaches the vertical plane through the central axes of the receiving rolls 6, 7 at exactly the moment in which the generating line 13 is likewise in this plane.

If a strip portion 1′ of a shorter length is to be severed, the front end of the strip 1 must reach the vertical plane through the central axes of the receiving rolls 6, 7 at a moment in which the receiving rolls 6, 7 have already rotated slightly further.

Figure 8:
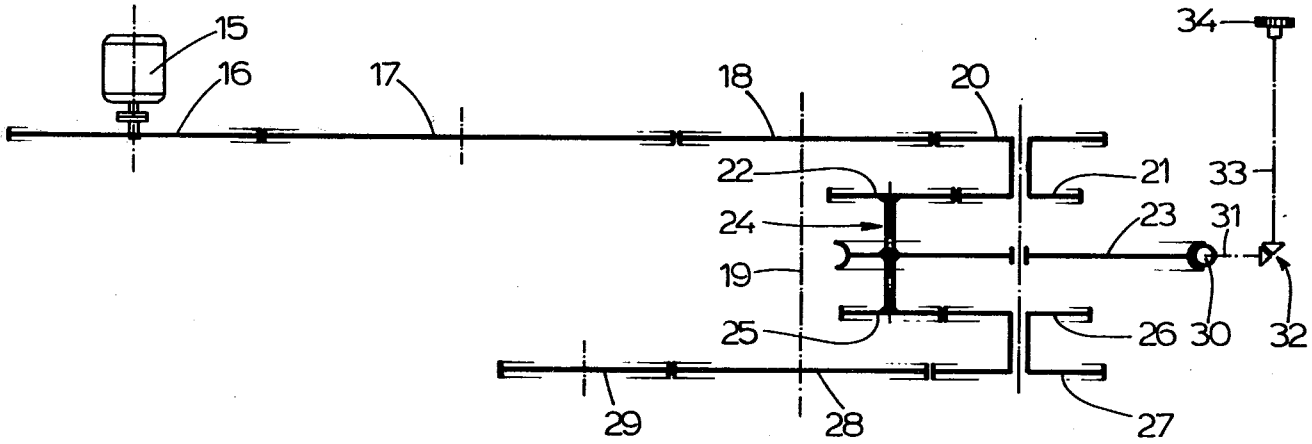
FIG. 8 shows schematically an embodiment of the adjusting mechanism for the advancing roll which is provided with a cam surface.

In order to accomplish this, the lower advancing roll 5 is coupled to an adjusting mechanism (FIG. 8).

In the embodiment according to FIG. 8, a drive motor 15 drives a gear wheel 16 which, through an interposed gear wheel 17, drives a gear wheel 18 which is loosely rotatable about its shaft 19 shown as a broken line. This gear wheel 18 meshes with a drive gear wheel 20 of a planet system, which gear wheel 20 is coupled to a co-axial first sun gear wheel 21. This sun gear wheel 21 meshes with a first planet gear wheel 22 of a planet 24 which is rotatably supported in a planet carrier 23 and which comprises a second planet gear wheel 25. This second planet gear wheel 25 is coupled to the first planet gear wheel 22, with which it is co-axial. The second planet gear wheel 25 furthermore meshes with a second sun gear wheel 26, the number of teeth of which is different from that of the sun gear wheel 21 and which is coupled to a co-axial gear wheel 27, which, through a gear wheel 28 which is journalled on the shaft 19, drives a gear wheel 29 which is coupled to the advancing roll 5. The feed roll 3 and the receiving roll 7 are also driven by the motor 15, but not through the planet system. For example, the gear wheel 18 can drive gear wheels (not shown) which are coupled to the feed roll 3 and to the receiving roll 7.

The planet carrier 23 consists of a worm wheel and is adjusted by means of a worm 30, which can be manually turned with a handle 34 to which it is connected by a rod 31, a right-angled transmission 32 and a rod 33.

If, through whatever cause, the length of the severed strip portions 1′ differs from the exact dimension required, and for instance a narrow piece of a strip is left, the length of the strip portions 1′ that are to be severed can be manually readjusted by turning the handle 34. If required, this can be done while the cutting apparatus is in operation. Since the number of teeth of the sun gear wheel 26 is different from that of the sun gear wheel 21, an adjustment of the handle 34 results in an angular displacement of the advancing roll 5 with respect to the receiving roll 7, so that the line of contact between the receiving roll 7 and the front end of the strip 1 is shifted and the length of the strip portion 1′ that is to be severed is modified.

In a prototype manufactured for research purposes, the gear wheel 16 had forty-two teeth, the gear wheel 17 had sixty-six teeth, the gear wheel 18 had forty-two teeth, the gear wheel 20 had twenty-eight teeth, the sun gear wheel 21 and the planet gear wheel 22 each had twenty teeth, the planet gear wheel 25 had sixteen teeth, the sun gear wheel 26 had twenty-four teeth, the gear wheel 27 had twenty-eight teeth, the gear wheel 28 had forty-two teeth, and the gear wheel 29, which provides the drive for the advancing roll 5, had twenty-eight teeth. In this embodiment, the gear wheel 18 drove two gear wheels with twenty-eight teeth, which were coupled to the feed roll 3 and to the receiving roll 7, respectively. Of course, it is possible to provide the receiving roll 7, instead of the advancing roll 5, with an adjusting mechanism.

The invention is not restricted to the example shown in the drawings, which may be varied in various manners within the scope of the appended claims.

I claim:

1. A cutting apparatus for severing portions of identical length from a strip, comprising a feed means which is coupled to a drive means and which is adapted to feed said strip to a pair of advancing rolls located between said feed means and a cutting element, one of said advancing rolls being coupled to the drive means and being provided with a cam surface having a larger radius than the remaining roll surface, which cam surface, together with the other advancing roll, being adapted to engage the strip and to move the strip forward towards a pair of receiving rolls through a distance determined by said cam surface, the central axes of said receiving rolls lying in a plane that is parallel to the plane through the central axes of the advancing rolls, said receiving rolls being located on the side of the cutting element remote from said advancing rolls, at such a distance from said advancing rolls that the front end of the strip, in the position where it is released by the advancing rolls, lies in the plane through the central axes of said receiving rolls, one of said receiving rolls being coupled to the drive means and being provided with a recess in its circumferential surface, said cutting element being controlled so as to perform the cutting operation at the moment in which this recess is located adjacent the other receiving roll, thus causing the strip to be released, whereupon the severed strip portion is removed, the driven advancing roll and the driven receiving roll being driven at the same peripheral velocity as measured with respect to their maximum radius, a manually operated adjusting mechanism being coupled to one of these latter rolls for readjusting this roll.

2. A cutting apparatus according to claim 1, wherein the adjusting mechanism is coupled to the driven advancing roll.

3. A cutting apparatus according to claim 1, wherein the cutting element is displaceable in a plane which is parallel to the aforementioned planes between an upper rest position and a lower position, while the feed means are adapted to feed the strip to a position wherein the front end of the strip abuts the cutting element which is in its lower position and which acts as a stop, whereupon the feed means release the strip.

4. A cutting apparatus according to claim 1, wherein the feed means comprise a pair of feed rolls, the central axes of which lie in a plane which is parallel with the aforementioned planes, one of said feed rolls being coupled to the drive means and comprising a cam surface with a longer radius than the remaining roll surface, said cam surface together with the other feed roll being adapted to engage the strip so as to displace the same.

5. A cutting apparatus according to claim 4, wherein said other feed roll is displaceable between an operating position, in which it is adapted to co-operate with the cam surface of the first feed roll so as to engage the strip, and a rest position, in which it is removed farther away from said first feed roll.

6. A cutting apparatus according to claim 1, wherein the strip is supported on a flat supporting table having a supporting surface, which extends at right angles to the aforementioned planes, said supporting table being provided with openings through which the underlying rolls can engage the strip.

7. A cutting apparatus according to claim 1, wherein the recessed receiving roll is provided with a second recess.

8. A cutting apparatus according to claim 7, wherein the leading end of said second recess lies simultaneously with the rear end of the severed strip portion in the plane through the central axes of the receiving rolls.

9. A cutting apparatus according to claim 1, wherein the advancing roll, provided with the cam surface is driven by an electromotor through a planet system comprising two sun gear wheels, the angular position of the planet carrier about the central axis of the sun gear wheels being adjustable by means of the adjusting mechanism.

10. A cutting apparatus according to claim 9, wherein the planet carrier consists of a worm wheel, which is adjustable by means of a worm coupled to a manually adjustable handle.

11. A cutting apparatus according to claim 10, wherein the planet system comprises a drive gear wheel coupled to the first sun gear wheel which is co-axial therewith, said first sun gear wheel meshing with a first planet gear wheel of a planet which is rotatably supported in the planet carrier and which comprises a second planet gear wheel, said second planet gear wheel being coupled to the first planet gear wheel and being co-axial therewith, said second planet gear wheel meshing with the second sun gear wheel, the number of teeth of which is different from that of the first sun gear wheel, and which is coupled to a co-axial gear wheel, said latter gear wheel driving the advancing roll.

12. A cutting apparatus according to claim 11, wherein a vacuum cylinder is arranged beyond the pair of receiving rolls and is coupled to the drive means.

13. A cutting apparatus according to claim 12, wherein a glueing cylinder is arranged adjacent the vacuum cylinder.

14. A cutting apparatus according to claim 12, wherein a moistening cylinder is arranged adjacent the vacuum cylinder.

* * * * *